US008926764B2

(12) United States Patent
Suiter

(10) Patent No.: US 8,926,764 B2
(45) Date of Patent: Jan. 6, 2015

(54) HOSE HANDLING SYSTEM AND METHODS OF USE

(71) Applicant: Thomas P. Suiter, Englewood, CO (US)

(72) Inventor: Thomas P. Suiter, Englewood, CO (US)

( * ) Notice: Subject to any disclaimer, the term of this patent is extended or adjusted under 35 U.S.C. 154(b) by 0 days.

(21) Appl. No.: 14/000,219

(22) PCT Filed: Nov. 27, 2012

(86) PCT No.: PCT/US2012/066602

§ 371 (c)(1),
(2) Date: Aug. 18, 2013

(87) PCT Pub. No.: WO2013/085746

PCT Pub. Date: Jun. 13, 2013

(65) Prior Publication Data

US 2014/0020716 A1 Jan. 23, 2014

Related U.S. Application Data

(60) Provisional application No. 61/568,476, filed on Dec. 8, 2011.

(51) Int. Cl.

| | |
|---|---|
| ***B08B 9/00*** | (2006.01) |
| ***B08B 5/04*** | (2006.01) |
| ***B08B 5/00*** | (2006.01) |
| ***B08B 7/00*** | (2006.01) |
| ***B08B 3/04*** | (2006.01) |
| ***B65H 75/44*** | (2006.01) |
| ***B65H 75/42*** | (2006.01) |
| ***B08B 9/023*** | (2006.01) |
| ***B65H 57/14*** | (2006.01) |
| *E03F 9/00* | (2006.01) |

(52) U.S. Cl.

CPC ..... *B08B 9/023* (2013.01); *B65H 2701/33* (2013.01); *B65H 75/4402* (2013.01); *B65H 75/425* (2013.01); *E03F 9/00* (2013.01); *B65H 57/14* (2013.01); *B65H 75/4478* (2013.01)

USPC ..... 134/22.1; 134/21; 134/26; 134/94.1; 134/167 R; 134/167 C

(58) Field of Classification Search

None

See application file for complete search history.

(56) References Cited

U.S. PATENT DOCUMENTS 3,573,862 A * 4/1971 Brown ..... 134/57 R
4,228,990 A 10/1980 Horvath (Continued)

FOREIGN PATENT DOCUMENTS

| | | | |
|---|---|---|---|
| JP | 2003-290542 | A | 12/1991 |
| JP | 2001-342661 | A | 12/2001 |
| KR | 2010-0987063 | B1 | 10/2010 |

*Primary Examiner* — Eric Golightly

*Assistant Examiner* — Arlyn I Rivera-Cordero

(74) *Attorney, Agent, or Firm* — Leyendecker and Lemire, LLC

(57) ABSTRACT

Embodiments of the present invention include a hose handling system having a hose guide plumbed via a wash line to a fluid delivery device. The hose guide includes a pulley installed on a frame member, and a spray nozzle adapted to dispense a wash mixture. The hose guide is adapted to guide a hose as the hose is inserted into or withdrawn from a manhole, with the hose traversing the pulley. The wash mixture can be delivered through a wash line to the hose guide, which sprays the wash mixture on the hose in order to reduce or eliminate gross contamination or microbial contamination on the hose. The wash mixture typically, but not necessarily, has a freezing point below 32 F and includes: a quaternary ammonium compound, an alcohol or glycol, an alcohol ethoxylate, and a fragrance.

14 Claims, 16 Drawing Sheets

(56) References Cited

U.S. PATENT DOCUMENTS 4,234,980 A * 11/1980 DiVito et al. ..... 15/302
4,280,672 A * 7/1981 Santos et al. ..... 242/534.2
5,356,480 A 10/1994 Melgeorge
2008/0248558 A1 * 10/2008 Deinhammer et al. ..... 435/264

* cited by examiner

HOSE HANDLING SYSTEM AND METHODS OF USE

The present patent application claims priority to and incorporates by reference in its entirety, U.S. patent application No. 61/568,476, filed 8 Dec. 2011, titled HOSE HANDLING SYSTEM, and having the same inventor as the present application.

FIELD OF THE INVENTION

The present invention relates generally to systems for handling and cleaning hoses and lines as they are retrieved from sanitary or storm sewers.

BACKGROUND

Hoses, lines, cables, and similar devices are frequently inserted into sewers in order to clean, repair, inspect, or otherwise maintain the sewer systems. The lines are typically retrieved from the sewer after use, whereupon the hoses can expose personnel and equipment to contamination from sewer contents that accompany the hoses as they leave the sewer. The hoses are typically stored and transported on sewer service vehicles, and contaminated vehicles can transfer contamination to points far removed from the sewer that is the source of the contamination.

The contamination can include human or animal excrement, medical waste, blood borne pathogens, antibiotic resistant bacteria, toxins, pathogens, and parasites, all of which are known to inhabit sanitary or storm sewers. The contamination thus presents a health threat to personnel retrieving the hoses, as well as others that come into contact with sewer cleaning and maintenance equipment.

Existing devices are adapted to span an open manhole and to help guide a hose during retrieval from a sewer through the manhole. However, the existing hose retrieval guidance devices do not reduce contamination, and moreover block access to the manhole by a sewer vacuum line when the existing device is installed in place over the manhole. Accordingly, a prior art guidance device must be removed or displaced from its operating position in order to insert a vacuum line into the sewer through the manhole. This circumstance necessitates extra handling of hoses, creating additional exposure of personnel to contamination. Removing or displacing prior art retrieval guidance devices from a manhole in order to insert a sewer vacuum line can also be time consuming because the retrieval guidance device is frequently reinstalled at the same location after a vacuum operation is performed.

DETAILED DESCRIPTION

Figure 1:
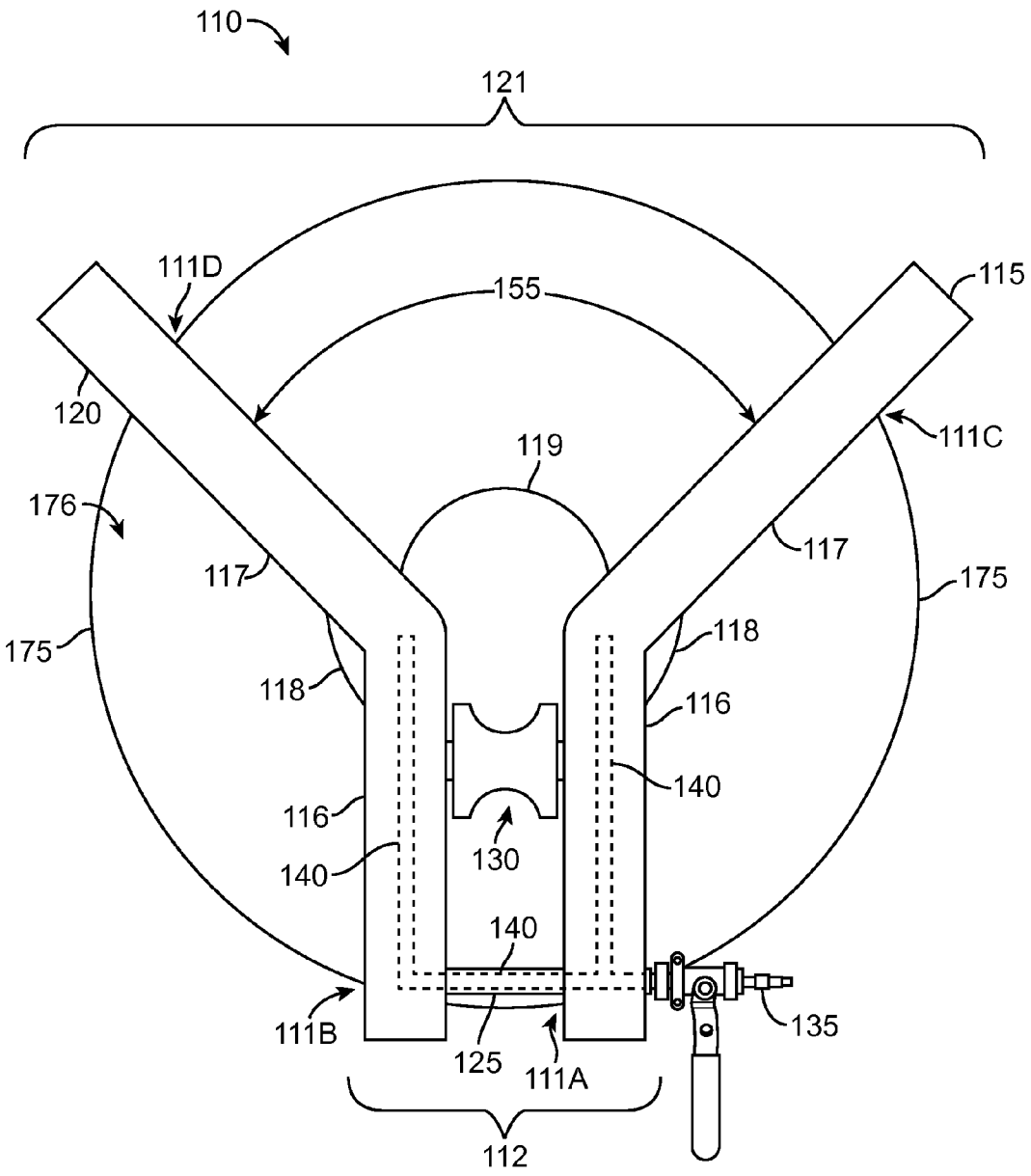
FIG. 1 is a top, plan view of a hose handling system according to an embodiment of the present invention.

Embodiments of the present invention comprise a hose handling system including a hose guide plumbed to a fluid delivery device via a wash line. Embodiments of the hose guide comprise a pulley installed on a frame member, and a spray nozzle adapted to dispense a wash mixture. The hose guide is adapted to guide a hose as the hose is inserted into or withdrawn from a manhole, with the hose traversing the pulley. In some embodiments, the wash mixture is delivered through a wash line to the hose guide, which sprays the wash mixture on the hose in order to reduce or eliminate contamination on the hose. Both gross contamination and microbial contamination are typically reduced through use of the hose handling system during retrieval of a hose from a sewer. The wash mixture typically, but not necessarily, includes: a quaternary ammonium compound; an alcohol or glycol selected from the group consisting of methanol, ethanol, isopropanol, n-propanol, ethylene glycol and propylene glycol; an alcohol ethoxylate; and a fragrance. Some embodiments of wash mixtures include stabilized chlorine dioxide.

The fluid delivery device typically comprises a wash concentrate tank for storing a wash concentrate, a variable speed metering pump for delivering the wash concentrate, and a main pump for delivering a wash mixture through the wash line to the hose guide. The wash mixture typically comprises the wash concentrate diluted with water. The fluid delivery device is typically installed on a sewer cleaning vehicle, and can utilize the vehicle's main water tank to compose and deliver the wash mixture.

The hose guide is configured to receive an 8 inch diameter or smaller vacuum line therethrough while the assembly is installed atop a manhole, with a jetter hose or other hose traversing the pulley and extending into the manhole. Accordingly, both the vacuum line and the hose can extend through the hose guide and into the manhole while the assembly is installed above the manhole.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word's or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment," "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The term "sewer," as used in this specification and appended claims, refers to storm sewers and sanitary sewers familiar to persons skilled in the art. Manholes typically, but not necessarily, provide access to the sewers.

The term "positive pressure," as used in this specification and appended claims, refers to pressure above an ambient or atmospheric pressure. Ambient pressure is typically, but not necessarily, about one atmosphere.

The terms "hose" or "hoses," as used in this specification and appended claims, refers to hoses, cables, lines and the like that are inserted into or withdrawn from manholes. The "hoses" are typically, but not necessarily, used to clean, repair, inspect, or otherwise maintain sewer systems, with access to the sewer systems being through the manhole. As used herein, "hoses" also includes cables, wires, or lines used for fiber optic, telephone, cable television, and similar communication means, which are sometimes accessed through manholes.

The term "operating position," as used in this specification and appended claims, refers to a position of a hose guiding device, where the device sits upright over a manhole, with the manhole cover removed, and a pulley of the guiding device in proper position for guiding a hose as the hose is inserted into or withdrawn from the manhole.

Directional or relational terms such as "top," "bottom," "upwardly," "downwardly," "above," "below," "inside," "outside," "upper," and "lower," as used in this specification and appended claims, refer to relative positions of identified elements, components or objects, when a hose guide and its constituent parts reside upright.

The term "mixture," as used in this specification and appended claims, refers to a liquid combination of two or more components. The liquid combination can be a solution, heterogeneous mixture, homogeneous mixture, emulsion, suspension, or combination thereof.

Figure 4:
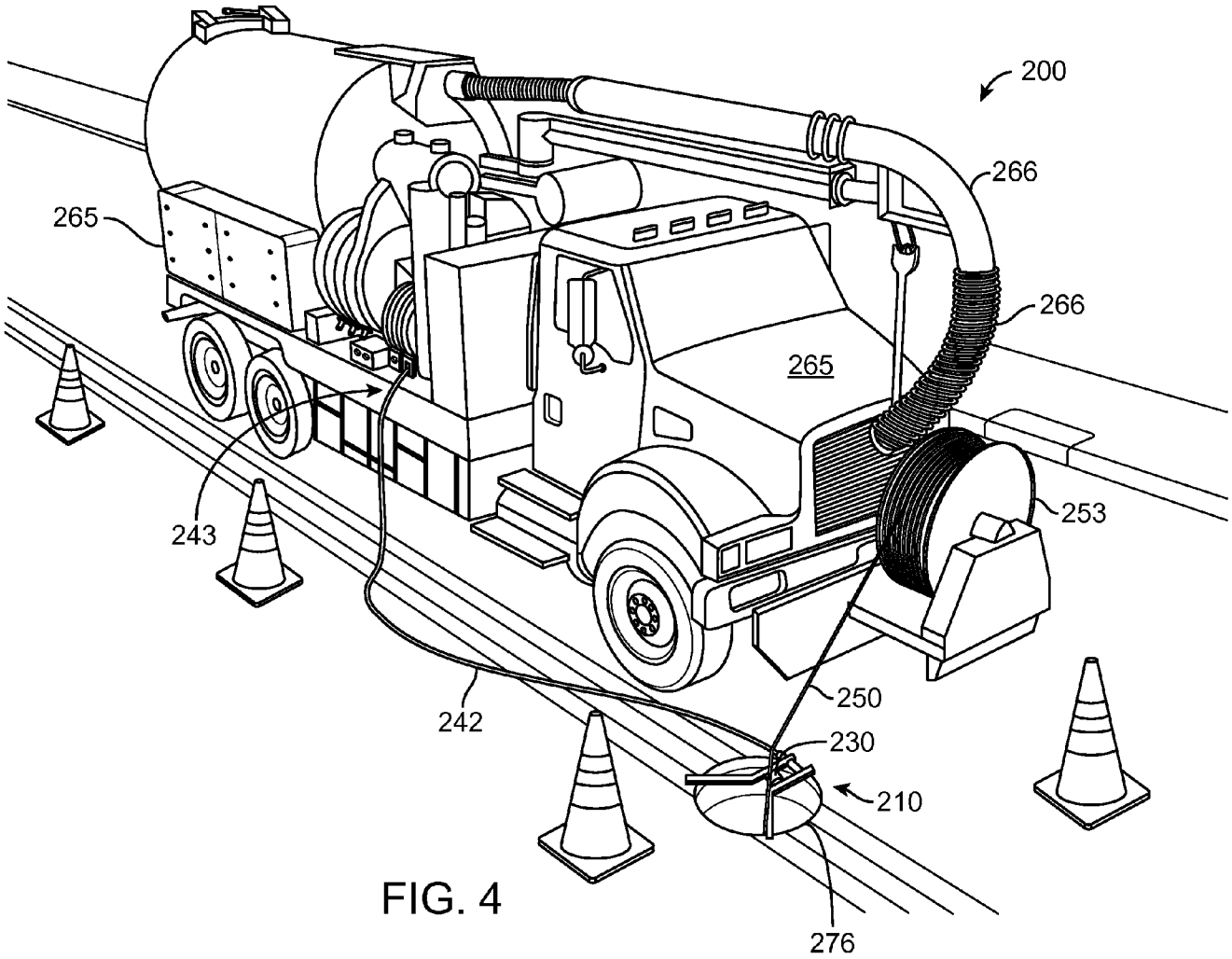
FIG. 4 is a perspective view of a hose handling system according to an embodiment of the present invention.
Figure 5:
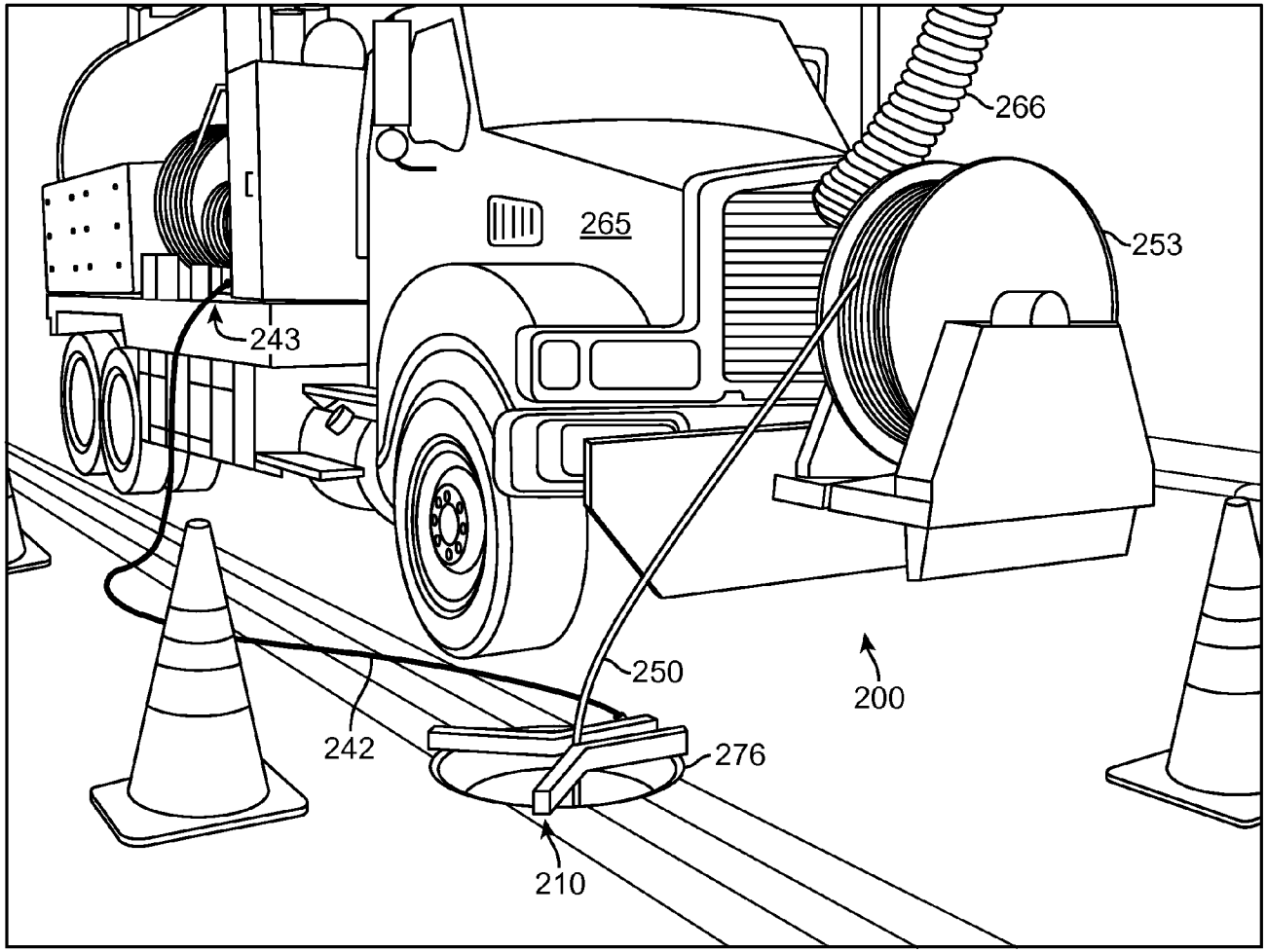
FIG. 5 is a perspective view of a hose handling system according to an embodiment of the present invention.
Figure 6:
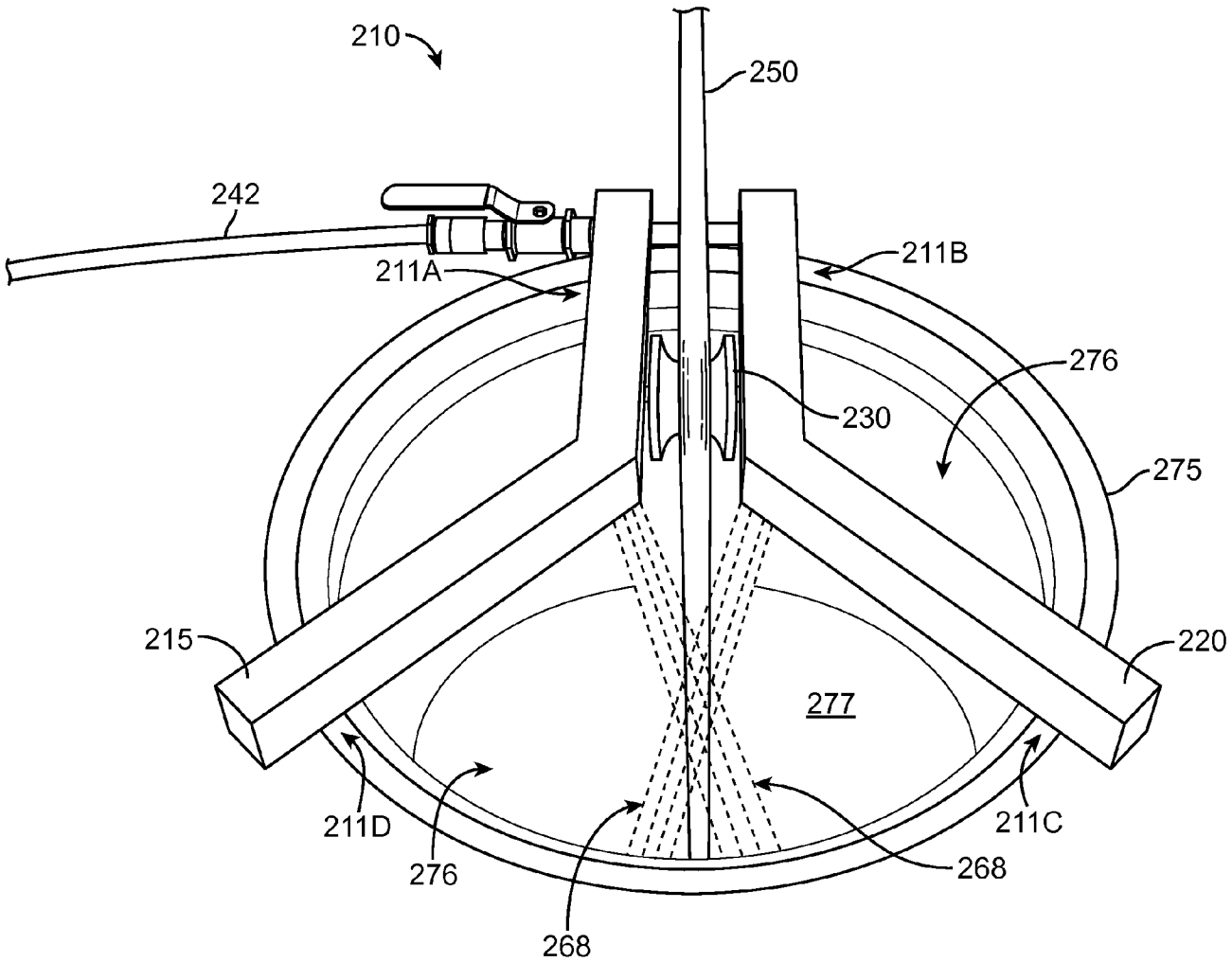
FIG. 6 is a perspective view of a hose handling system according to an embodiment of the present invention.
Figure 7:
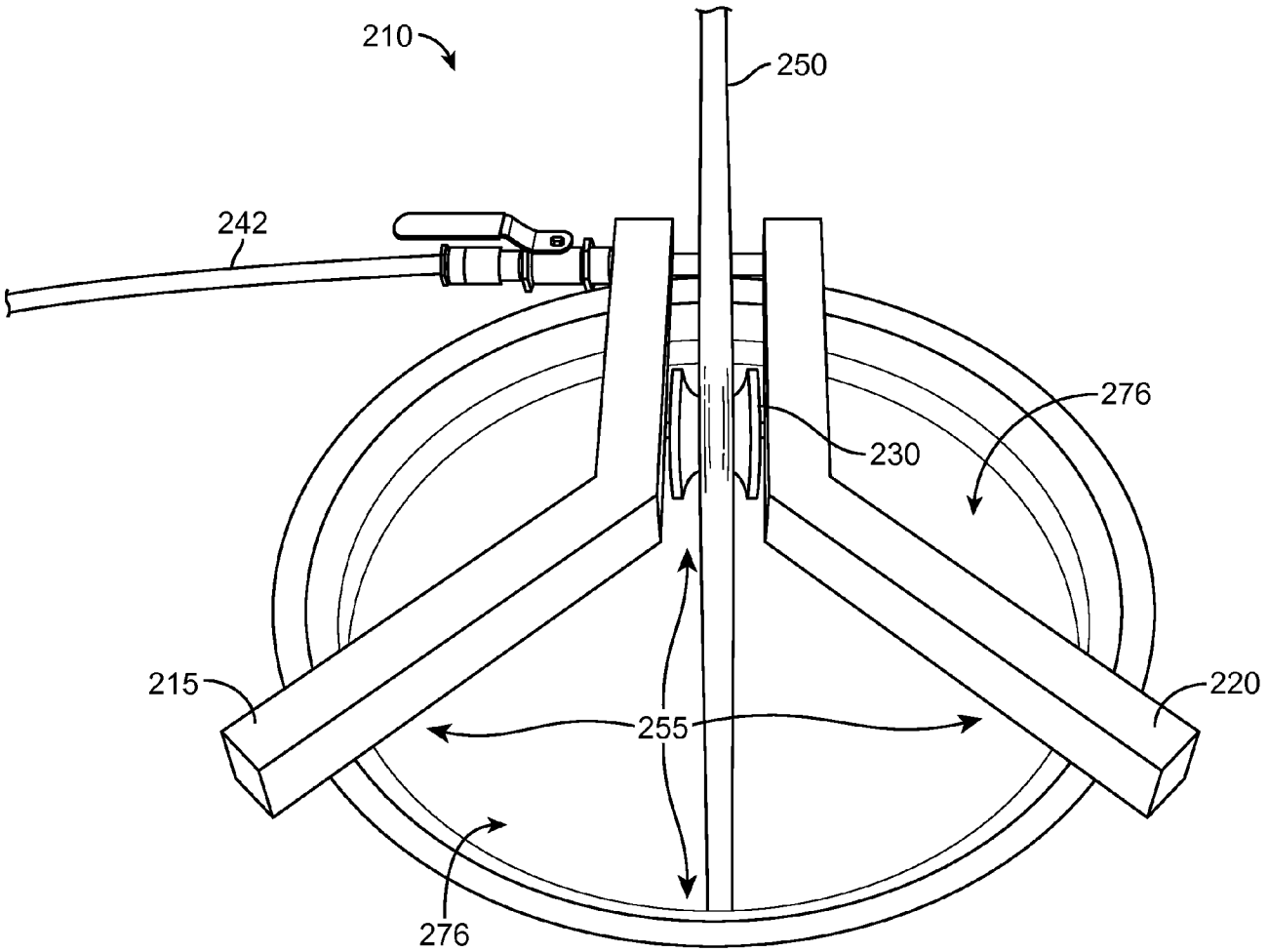
FIG. 7 is a perspective view of a hose handling system according to an embodiment of the present invention.

The terms "traverse," "traversing," "traverses," and similar terms, as used in this specification and appended claims, refer to interaction of a hose with a hose guide pulley, where the hose runs through a manhole and contacts the pulley. The hose generally changes orientation as it contacts the pulley, changing from a more vertical orientation as the hose comes up through the manhole, to a less vertical orientation as the hose contacts the pulley and extends toward a sewer truck or other device. FIGS. 4, 6, and 7 show a hose traversing a pulley.

The terms "sewer cleaning vehicle," "sewer cleaning vehicles," "sewer service vehicles," and similar terms, as used in this specification and appended claims, refer to relatively large vehicles used by commercial and municipal sewer cleaning personnel, and also to smaller camera inspection vehicles. Sewer cleaning vehicles typically comprise a hose, the hose being adapted to carry water under relatively high pressure (preferably over 100 psi, more preferably 500 to 2500 psi, and most preferably 1500-2000 psi) into sewer lines. Sewer cleaning vehicles typically include about 500 feet of the hose installed on a large reel. The hose is frequently equipped with a jet nozzle adapted to propel the jet nozzle (and hence the hose to which it is attached) into a sewer line when the water under relatively high pressure exits the jet nozzle, thereby providing jet force that propels the jet nozzle. The hose and jet nozzle can be collectively referred to as a jetter. Sewer cleaning vehicles include large water tanks, the large water tanks sometimes having a capacity of about 1000 gallons, and almost always having a capacity over 100 gallons. Examples of sewer cleaning vehicles include, but are not limited to, Vactor® sewer cleaning trucks (including 2100 Plus, 2100 Series Fan, 2100 Series PD, and 2103 models), vehicles and trailers from Sewer Equipment of America® (including model 800-HPRTV, 800-HPR, 800-H, 800-HF, 747-TK and 800 truck jets, and model 747-FR2000TV, 747-FR2000, and 747-4000 trailer jets), and sewer cleaning vehicles from VAC-CON®. Sewer service vehicles include camera inspection vehicles such as, but not limited to, those from Cues, Pearpoint, Aries, and Rapid View.

The term "antimicrobial," "antimicrobial substance," "antimicrobial agent," and similar terms, as used in this specification and appended claims, refers to a substance (or property thereof) that destroys, kills, or inhibits the growth, development, or pathogenic activity of microorganisms. Antimicrobial substances include, but are not limited to, substances having antibacterial or antifungal properties. Soaps and detergents that reduce microorganism abundance merely by reducing adhesion of the microorganisms, in the absence of other antimicrobial action, do not qualify as antimicrobial substances.

A First Embodiment Hose Handling System

Figure 2:
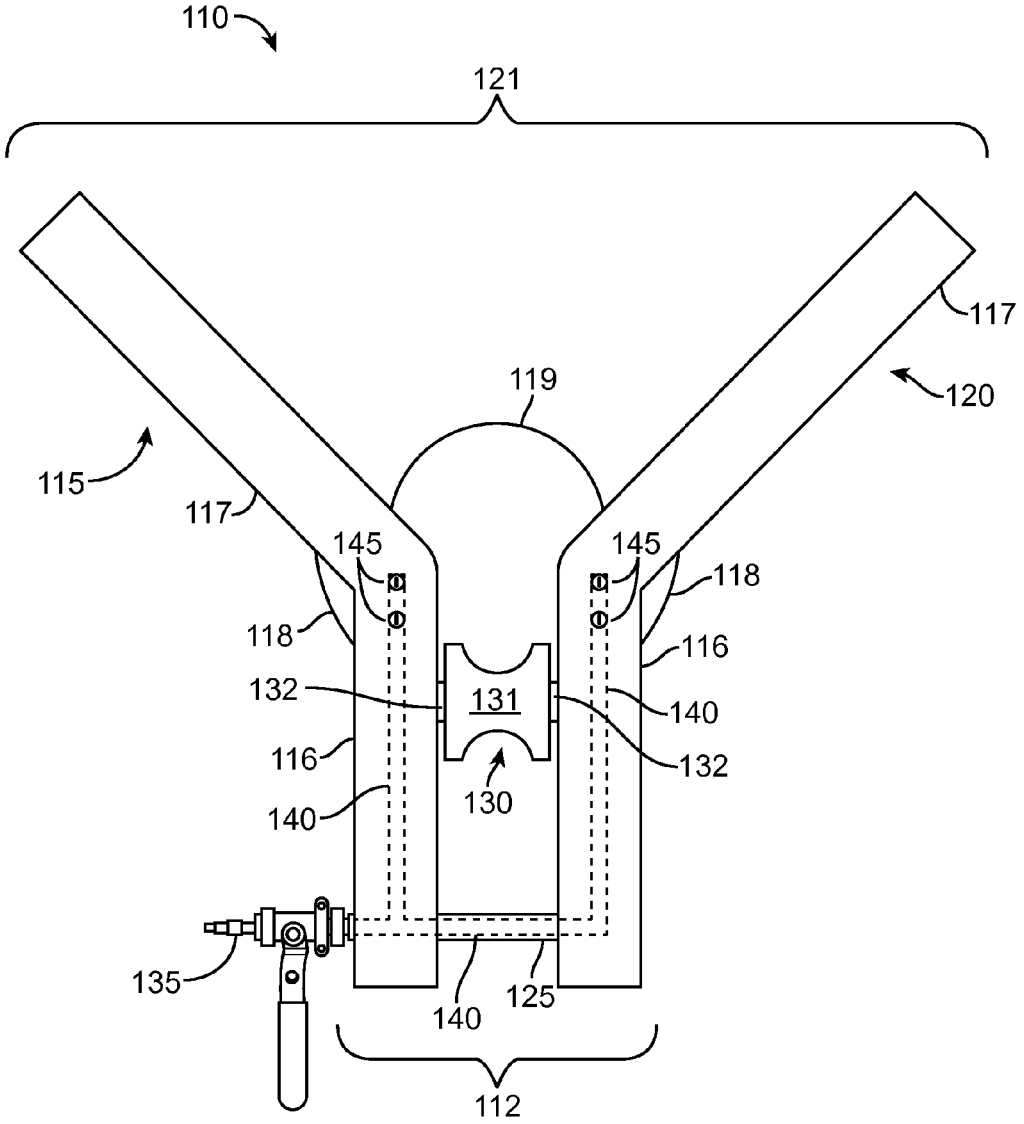
FIG. 2 is a bottom, plan view of a hose handling system according to an embodiment of the present invention.

A hose guide 110 of a first embodiment hose handling system is illustrated in FIGS. 1-2. The first embodiment hose guide 110 comprises a first frame member 115 and a second frame member 120 coupled to each other with a connecting member 125 and a pulley 130. The frame members each comprise a base portion 116 and an arm portion 117. The frame members 115,120 of the first embodiment are machined from a solid 6061 aluminum bar. In other embodiments, frame members can be made of materials including, but not limited to, polymers, epoxides, fiber-glass, wood, metals and metal alloys, and composites including carbon fiber/resin composites. Polymers include, but are not limited to, polyvinyl chloride (PVC), polyoxymethylene homopolymers and copolymers, acrylonitrile butadiene styrene (ABS), polyethylene terephthalate (PET), polyetheretherketone (PEEK), polyimide, polycarbonate, polyaniline, acrylate or methacrylate polymers, or fluorinated polymers such as polytetrafluoroethylene or polyfluoroethylenepropylene, and polyolefins such as polyethylene (PE), polypropylene (PP) or polybutylene (PB).

The pulley 130 includes a roller 131 and an axle 132. The axle typically comprises steel, and inserts into the first and second frame members 115, 120 by over an inch. Similarly, the connecting member is typically steel and also inserts into the first and second frame members by over an inch. The connecting member and axle typically include threaded ends that screw into threaded receptacles residing in the first and second frame members. Accordingly, the pulley axle 132 and the connecting member 125 provide rigid connections between the first and second frame members, such that the hose guide is substantially rigid. A space between the base portions 116 of the first and second frame members is typically about three inches. In some variations, the space between the base portions 116 of the first and second frame members is about 1.0-3.0 inches.

For each of the first and second from members 115, 120 a first angle 118, where the base portion 116 meets the arm portion 117, is approximately 135°. Accordingly, the arm portions 117 of each frame member diverge from each other at a second angle 119 of approximately 90°. In other embodiments, the first angles are preferably <180°, more preferably between 158° and 90°, and most preferably about 135°. First angles for first and second frame members are typically, but not necessarily, approximately equal. In some embodiments, the second angle is preferably at least 30°, more preferably between 45° and 180°, still more preferably between 60° and 135°, and most preferably about 90°.

The hose guide 110 further comprises an inlet valve 135 and spray nozzles 145 plumbed into a channel system 140. The pulley 130 is configured to receive, and provide a relatively low friction contact point for, a hose that is being deployed into or retrieved from a sewer. The spray nozzles 145 are configured to direct a spray of fluid onto a hose that traverses the pulley.

The channel system 140, shown in hidden line because its channels reside inside the first and second frame members 115, 120 and connecting member 125, provides paths of fluid communication between the inlet valve 135 and spray nozzles 145. In some embodiments, the pulley axle 132 is hollow and forms part of the channel system 140 to provide a path of fluid communication between the first and second frame members.

As best shown in FIG. 2, which provides a view of an underside of the hose guide 110, the spray nozzles 145 are coupled directly to the frame members and project downwardly therefrom. The spray nozzles of the first embodiment include ¼" MEG nozzles with a spray angle of 25°, from Spraying Systems Co. (Glendale Heights, Ill.). Variations include other nozzles configured to direct a stream or spray of fluid.

The spray nozzles 145 are configured to direct a spray of fluid downwardly from the hose guide. The fluid is typically, but not necessarily, an aqueous wash mixture comprising an antimicrobial agent, a freezing point lowering agent, a surfactant, and a fragrance. The wash mixture is typically delivered under positive pressure to the inlet valve 135, which opens or closes to allow or block flow, respectively, of the wash mixture into the channel system. The inlet valve of the first embodiment is a typically, but not necessarily, a ball valve.

As best shown in FIG. 1, which illustrates a first embodiment hose guide 110 upright, in its operating position, over a manhole 176, the guide assembly 110 spans the manhole with the assembly's frame members 115, 120 extending beyond the manhole perimeter 175. The frame members 115,120 together form a frame 121 that is generally Y-shaped, with the arm portions 117 residing in a common plane and being non-parallel. The arm portions 117 converge to become closest together proximate the pulley 130. The arm portions 117 typically converge as they approach the base portions 116 and pulley 130, but the arm portions typically do not actually meet each other. When assembled into the frame 121, the base portions 116 are typically parallel and reside in the same plane as the arm portions 117. For the purposes of this specification and appended claims, parallel means within 11.5° of perfectly parallel, and non-parallel means greater than 11.5 degrees from parallel. Collectively, the base portions 116 of the frame members 115,120 form a base 112 of the frame 121. The arm portions 117 diverge from the base 112, which creates a relatively large open zone 155 between the arm portions 117 of the frame 121. The open zone 155 provides access through the hose guide 110 and into the manhole while the guide assembly 110 resides in its operating position above the manhole.

As best shown in FIG. 1, the first embodiment hose guide 110 is typically supported at or proximate the manhole periphery 175 at four points 111A-111D. Embodiments are supported by the ground at or proximate a manhole periphery at preferably at least two points and most preferably at least three points.

Figure 3:
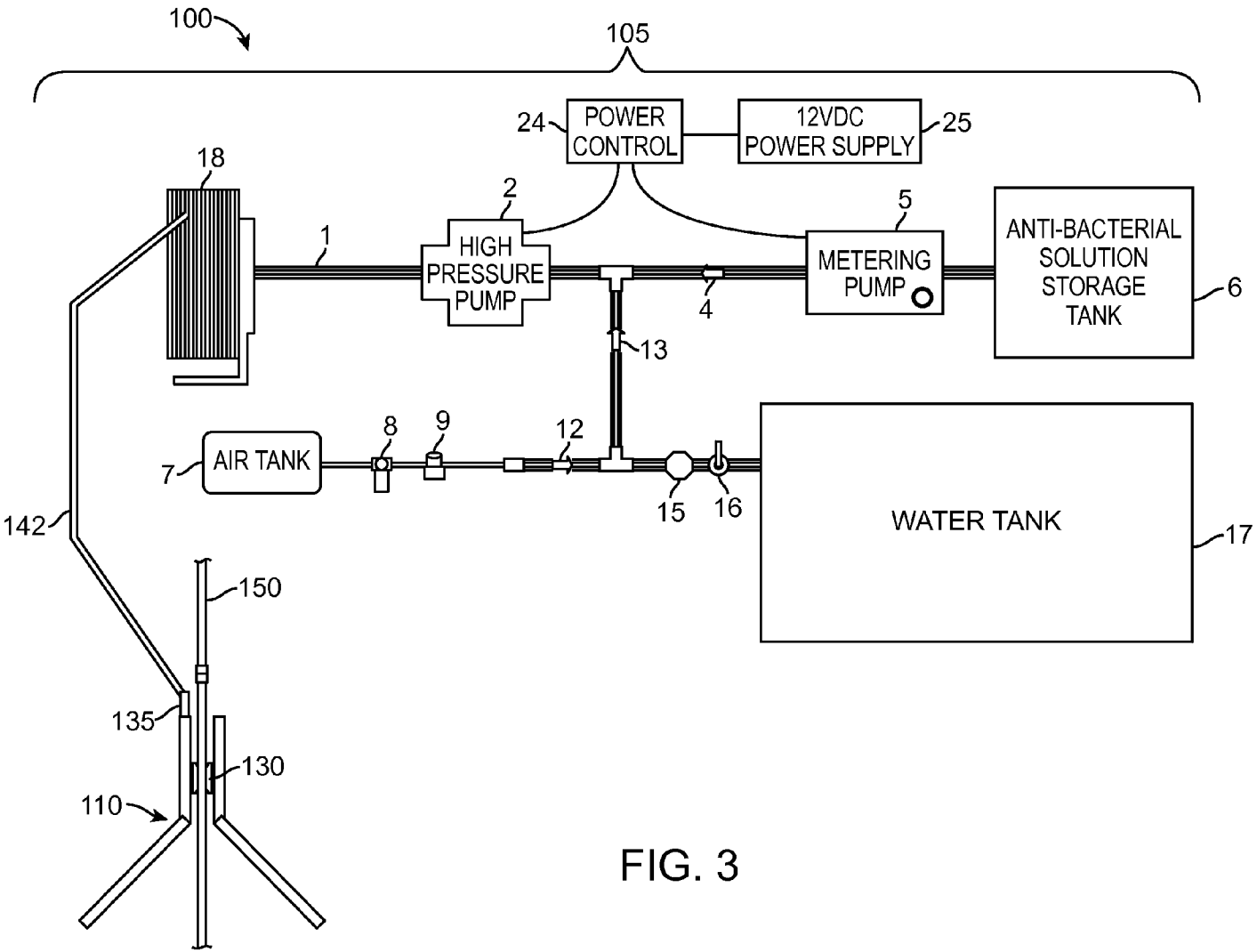
FIG. 3 is a schematic view of a hose handling system according to an embodiment of the present invention.

FIG. 3 is a schematic representation of a first embodiment hose handling system 100, which includes the hose guide 110 and a fluid delivery device 105. The fluid delivery device 105 includes a wash concentrate tank 6 plumbed to a variable speed metering pump 5, which is plumbed to a tee fitting 3. Plumbing between components of the fluid delivery device 105 includes a fluid path 1 typically comprising ½ inch tubing. The wash concentrate tank 6 contains a wash concentrate that typically, but not necessarily, comprises a relatively small amount of water, a quaternary ammonium compound, propylene glycol or isopropyl alcohol, a surfactant, and fragrance. A main water pump 2 downstream from the tee fitting 3 delivers the wash mixture, comprising the wash concentrate diluted with water, to a wash line 142. The wash line conducts the wash mixture to the hose guide 135. The water pump typically, but not necessarily, delivers the wash mixture at a flow rate of up to 2 gallons per minute (gpm) and a pressure of at least 100 pounds per square inch (psi). Embodiments are configured to deliver wash mixture at a pressure preferably at least 25 psi, more preferably at least 50 psi, and most preferably at least 75 psi. The wash line 142 of the first embodiment is ⅜" water hose, and is stored on a wash line reel 18. Delivery of wash mixture at a pressure of at least 25 psi, and in some cases at least 50 psi, at least 75 psi, or at least 100 psi, can facilitate delivering a relatively powerful wash spray from the nozzles, which can assist with removal of gross contamination from a hose.

A sewer truck air tank 7 and a truck main water tank 17 are also plumbed to the tee fitting 3. Flow from the main water tank 17 can be turned on and off with a ball valve 16, and is typically filtered by an 80 mesh strainer 15. At the tee fitting 3, the wash concentrate typically mixes with water from the truck main water tank to form the wash mixture. The variable speed metering pump 5 is a peristaltic pump adapted to meter delivery of the wash concentrate in order to control abundance of wash concentrate in the wash mixture. Accordingly, a stronger or weaker wash mixture can be delivered to the wash line 142, depending on circumstances. For instance, where a sewer back up or other spill has occurred, a stronger wash mixture may be delivered to the wash line, and the wash line can be disconnected from the hose guide 110 in order to hose down the street or other areas contaminated by the spill. Back-flow within the fluid delivery device is typically prevented through use of first, second, and third check valves 4, 12, 13. The main water pump 2 and metering pump 5 are typically controlled with a power control unit 24, which typically operates on 12 to 24 volts DC power from a power supply 25.

In normal operation, where a hose 150 such as a jetter hose is being withdrawn from a manhole, a wash mixture containing less wash concentrate than the stronger wash mixture described above is typically delivered to the hose guide 110, and subsequently sprayed onto the hose 150 in close proximity to the pulley 130. The jetter hose is thus typically washed to reduce or remove contamination just before the jetter hose traverses the pulley during withdrawal of the jetter hose from the manhole.

Water from the truck main water tank 17 can also be delivered to the wash line 142 in the absence of wash concentrate, thus facilitating a water rinse of the main water pump, wash line, and hose guide 110. Similarly, air from the sewer truck air tank 7 can be used to blow liquid from the main water pump, wash line, and hose guide. An air reducer valve 8 and air on/off switch 9 facilitate delivery of air from the air tank 7 to the fluid path 1.

A Second Embodiment Hose Handling System

A second embodiment hose handling system 200 is illustrated in FIGS. 4-7. The second embodiment hose handling system comprises a hose guide 210 similar to and including the same components as the hose guide 110 of the first embodiment hose handling system 100. The second embodiment hose handling system 200 comprises a high pressure hose 250 extending from a high pressure hose reel 253 mounted on a sewer cleaning truck 265 down through a manhole 276 into a sewer 277. The high pressure hose 250 is guided by the pulley 230 of the hose guide 210 as the hose 250 is retrieved onto the high pressure hose reel 253. The high pressure hose of the second embodiment hose handling system is a jetter hose. Other embodiments include other hoses or lines, including, but not limited to hoses or lines having outside diameters of about ⅜ inch to 2 inches.

The second embodiment hose handling system 200 further comprises a wash line 242 that delivers a wash mixture under positive pressure from a fluid control assembly 243 to the hose guide 210. The wash mixture typically, but not necessarily, includes water, a quaternary ammonium compound or other antimicrobial agent, a freezing point lowering agent, a surfactant, and a fragrance. Variations of wash mixtures include stabilized chlorine dioxide.

The wash mixture of the second embodiment hose handling system typically includes a wash concentrate comprising a proprietary formulation from B&B Blending, Inc. (Denver, Colo.) that has a freezing point of about 5° F. The proprietary formulation includes a quaternary ammonium compound, a freezing point lowering agent, a surfactant, and a fragrance. Examples of fragrances include, but are not limited to, vanilla fragrance, pine fragrance, and apple fragrance. Variations of wash concentrate include stabilized chlorine dioxide.

The wash concentrate is typically diluted with water to form the wash mixture.

Examples of quaternary ammonium compounds used in a typical wash mixture include, but are not limited to, dimethyl ammonium chloride; dimethyl benzyl ammonium chloride; alkyl dimethyl benzyl ammonium chloride compounds such as n-dodecyl dimethyl benzyl ammonium chloride, n-hexadecyl dimethyl benzyl ammonium chloride, n-octadecyl dimethyl benzyl ammonium chloride, and n-tetradecyl dimethyl benzyl ammonium chloride; and alkyl dimethyl ethylbenzyl ammonium chloride compounds such as n-dodecyl dimethyl ethylbenzyl ammonium chloride and n-octadecyl dimethyl benzyl ammonium chloride.

Examples of freezing point lowering agents used in the wash mixture include, but are not limited to, propylene glycol and isopropyl alcohol. Other alcohols or glycols, including but not limited to methanol, ethanol, n-propanol, and ethylene glycol, can be used as freezing point lowering agents. Examples of surfactants used in the wash mixture include, but are not limited to, alkyl dimethyl benzyl ammonium chloride compounds, alkyl dimethyl ethylbenzyl ammonium chloride compounds, and alcohol ethoxylates.

As best shown in FIG. 6, the wash mixture is forced through spray nozzles, which direct a wash spray 268 sprayed onto the high pressure hose 250 proximate (within 24 inches of) the pulley 230. Embodiments include wash spray that hits the hose 250 preferably within 16 inches of the pulley 230, more preferably within 10 inches of the pulley, and most preferably within 5 inches of the pulley. The high pressure hose 250 is thus washed as it is retrieved from the sewer. Where the wash mixture includes an anti-microbial agent and a surfactant, the hose can be disinfected by the wash mixture, and the surfactant can assist with removing gross contamination as well as facilitating disinfection. Channels (not shown in FIGS. 4-7) disposed inside the frame members allow fluid communication between the wash line 242 and the spray nozzles. The spray nozzles are not visible in FIGS. 4-7 because they are disposed on the underside of first and second frame members 215, 220.

The high pressure hose 250 generally changes orientation as it contacts the pulley 230, changing from a more vertical orientation as the hose 250 comes up through the manhole 276, to a less vertical orientation as the hose 250 contacts the pulley 230 and extends toward the sewer truck 265 or other device. The change in orientation of the hose 250 as it contacts the pulley 230, best seen in FIGS. 4 and 5, can be referred to as a change in angle of retrieve.

The sewer cleaning truck 265 includes a sewer vacuum line 266 having an outside diameter of approximately 8 inches, which will not fit past a prior art hose retrieval guidance device installed atop a manhole. Sewer vacuum lines have an outside diameter preferably at least 4 inches, more preferably at least 6 inches, and most preferably at least 8 inches.

As best seen in FIG. 7, the hose guide 210 of the second embodiment hose handling system includes an open zone 255. The open zone is large enough to receive the 8 inch outside diameter sewer vacuum line 266 while the hose guide 210 is installed in operating position over a manhole 276, with the high pressure hose 250 traversing the pulley. The hose guide 210 can be configured to direct wash spray 268 onto the vacuum line 266 while the vacuum line extends through the open zone 255

A Third Embodiment Hose Handling System

A hose guide 310 of a third embodiment hose handling system is illustrated in FIGS. 8-12. The third embodiment hose guide 310 comprises a first frame member 315 and a second frame member 320 coupled to each other with a connecting member 325 and a pulley 330. The pulley comprises a roller 331 and a steel axle 332. The steel axle typically threads about 1-1.5 inches into each of the first and second frame members 315,320, thereby providing a rigid connection between the frame members. The connecting member 325 typically provides another rigid connection between the frame members. The hose guide is thus substantially rigid. The frame members each comprise a base portion 316 and a arm portion 317. A distance of about 3 inches typically, but not necessarily, separates the base portions 316 of the first and second frame members 315, 320. The frame members of the third embodiment are machined from a solid 6061 aluminum alloy bar. A width 355 of each frame member is typically 2 inches, plus or minus 1/16 inch. The hose guide exhibits bilateral symmetry, with the first frame member 315 and the second frame member 320 being mirror images of each other, save for minor details. For each of the first and second frame members, a first angle 318 where the base portion 316 meets the arm portion 317 is approximately 135°.

The hose guide 310 further comprises a ball valve 335 and four spray nozzles 345 plumbed into a channel system (not shown—channels are typically drilled into the frame members and are not visible in the views shown in FIGS. 8-12). The spray nozzles of the third embodiment include ¼" MEG nozzles with a spray angle of 25°, from Spraying Systems, Co. Other embodiments comprise other spray nozzles, including, but not limited to, flat spray nozzles, full cone spray nozzles, hollow cone spray nozzles, and fine spray nozzles. The spray nozzles typically, but not necessarily, thread into ¼ inch holes machined into the frame members 315, 320.

Figure 8:
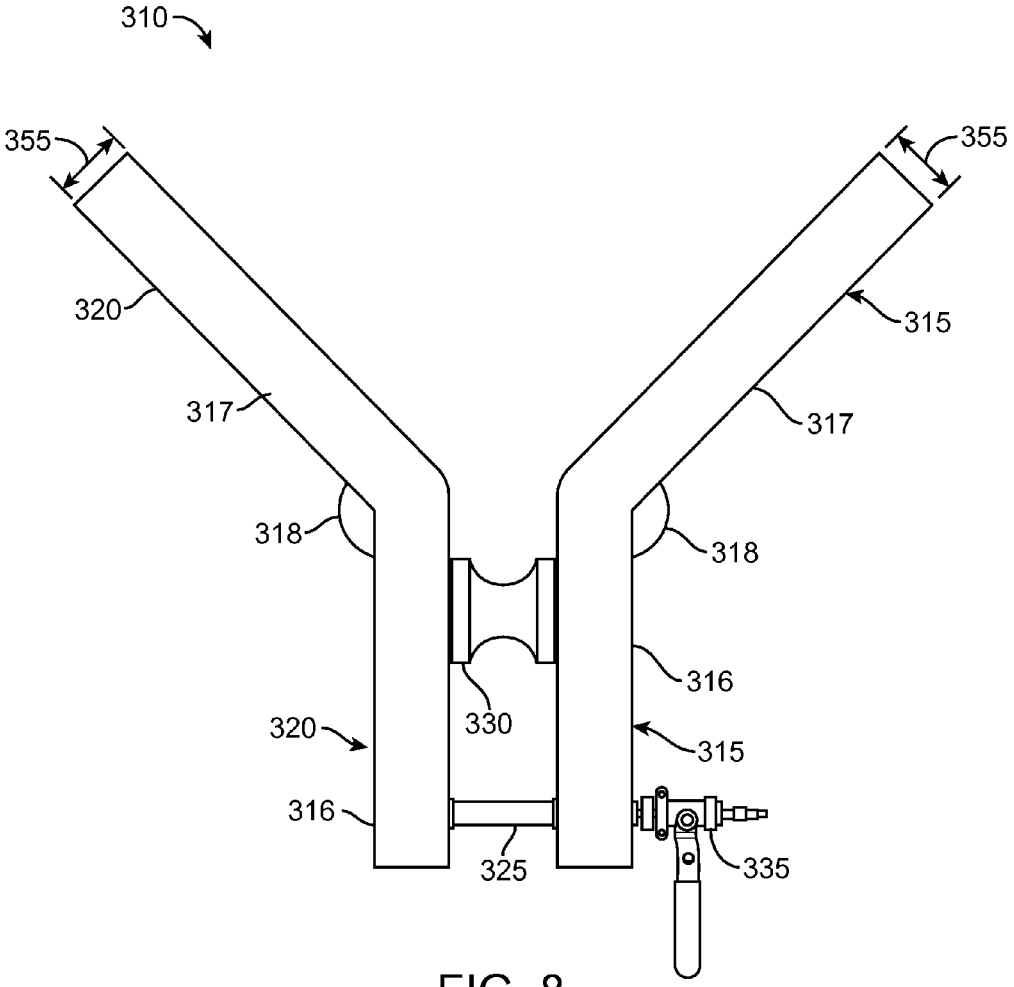
FIG. 8 is a top, plan view of a hose handling system according to an embodiment of the present invention.
Figure 9:
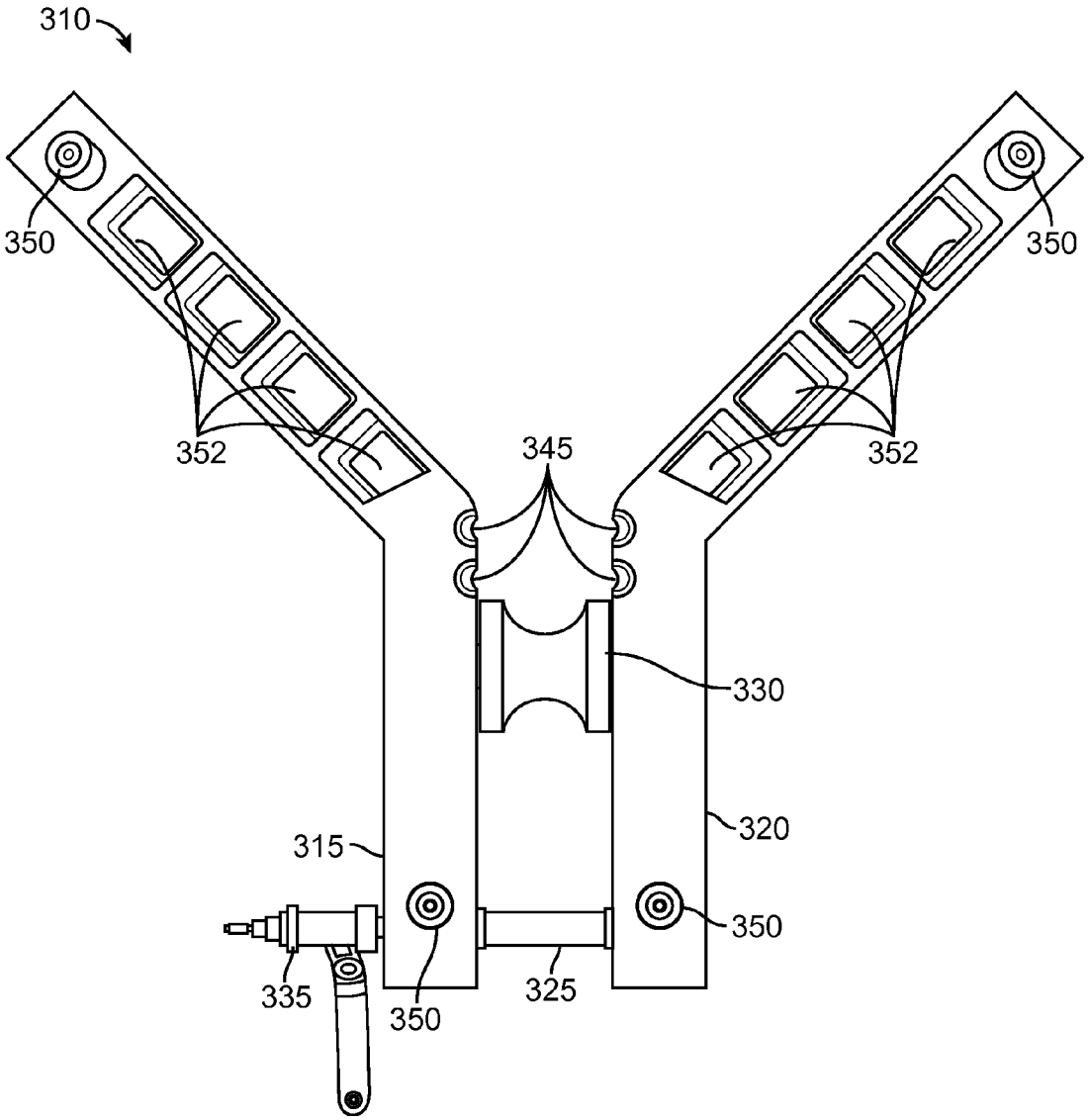
FIG. 9 is a bottom, perspective view of a hose handling system according to an embodiment of the present invention.
Figure 10:
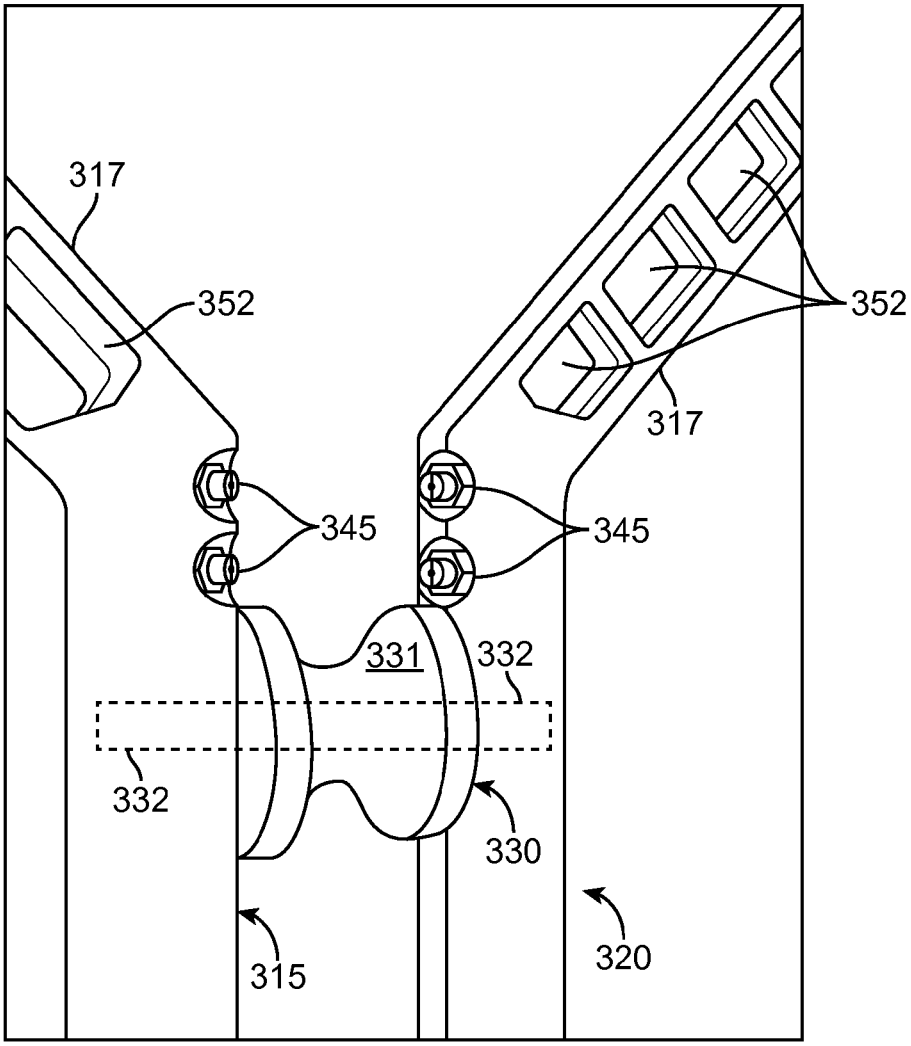
FIG. 10 is a bottom, perspective view of a hose handling system according to an embodiment of the present invention.
Figure 11:
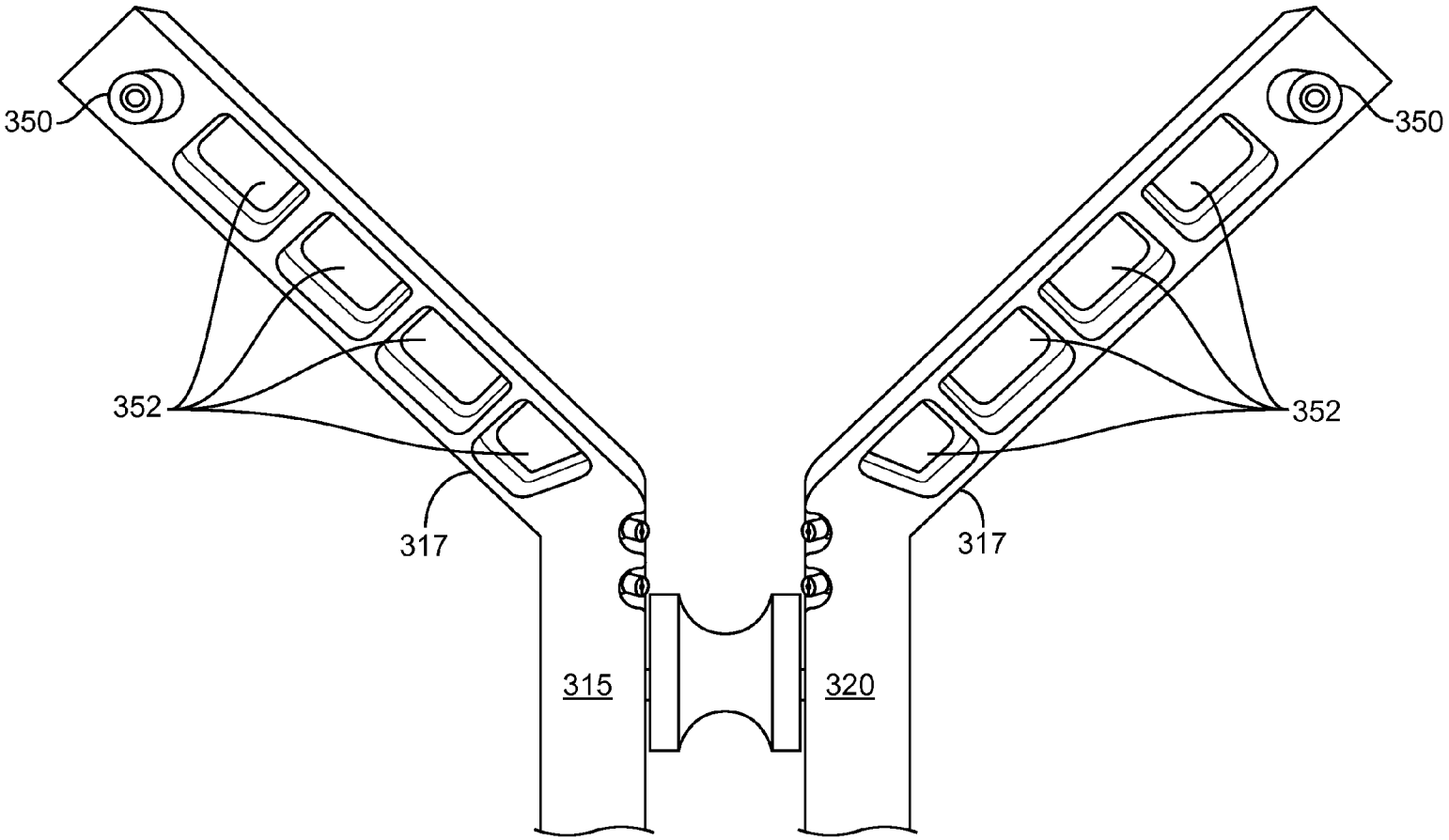
FIG. 11 is a bottom, perspective view of a hose handling system according to an embodiment of the present invention.

A top side of the third embodiment hose guide 310 is illustrated in FIG. 8, and an underside is illustrated in FIGS. 9-11. As best seen in FIGS. 9 and 11, the hose guide further comprises four positioning stubs 350 projecting downwardly from the first and second frame members 315, 320. The positioning stubs are stainless steel, and are coupled directly to the frame members by use of threaded fasteners that thread into threaded holes residing in an underside of the frame members. When oriented in an operating position over a 24 inch diameter manhole, the positioning stubs 350 project into the manhole just inside an outer perimeter of the manhole. The positioning stubs thereby help hold the hose guide in operating position. The positioning stubs typically project downwardly about 1 inch, and reside on the perimeter of a circle having a diameter of approximately 22 inches. Manholes typically have a ledge just inside the manhole opening, which supports a manhole cover that resides just inside the manhole opening. The ledge has an outside diameter that is equivalent to the manhole opening diameter, and an inside diameter that is slightly smaller than the manhole opening diameter. For the purposes of this specification and appended claims, a diameter of a manhole refers to the diameter of the manhole opening, which should be equivalent to the outside diameter of the inside ledge, but not to the inside diameter of the inside ledge.

Other manholes have diameters larger or smaller than 24 inches. Hose guide assemblies adapted to fit the other manhole diameters typically, but not necessarily, include multiple positioning stubs that reside on a circle having a diameter about 2 inches less than the diameter of a manhole for which the hose guide is designed, such that the positioning stubs fit just inside the manhole when the hose guide is in operating position atop the manhole. Generally, the multiple positioning stubs reside on a positioning stub circle that has a diameter less than a diameter of a manhole on which the hose guide is designed and adapted to be used, a difference between the positioning stub circle diameter and the manhole diameter being preferably at least ½ inch, more preferably between 1 inch and 6 inches, and most preferably about 2 inches. Variations of positioning stubs include one or more steps, the one or more steps of the stepped positioning stubs being configured to sit just inside manhole perimeters of various sizes. It is understood that the positioning stub circle is a mental construct and is typically not an actual physical structure.

As best shown in FIGS. 9-11, the frame members 315, 320 include cavities 352 machined into their arm portions 317. The cavities reduce the mass of the hose guide 310 without compromising functional strength.

Figure 12:
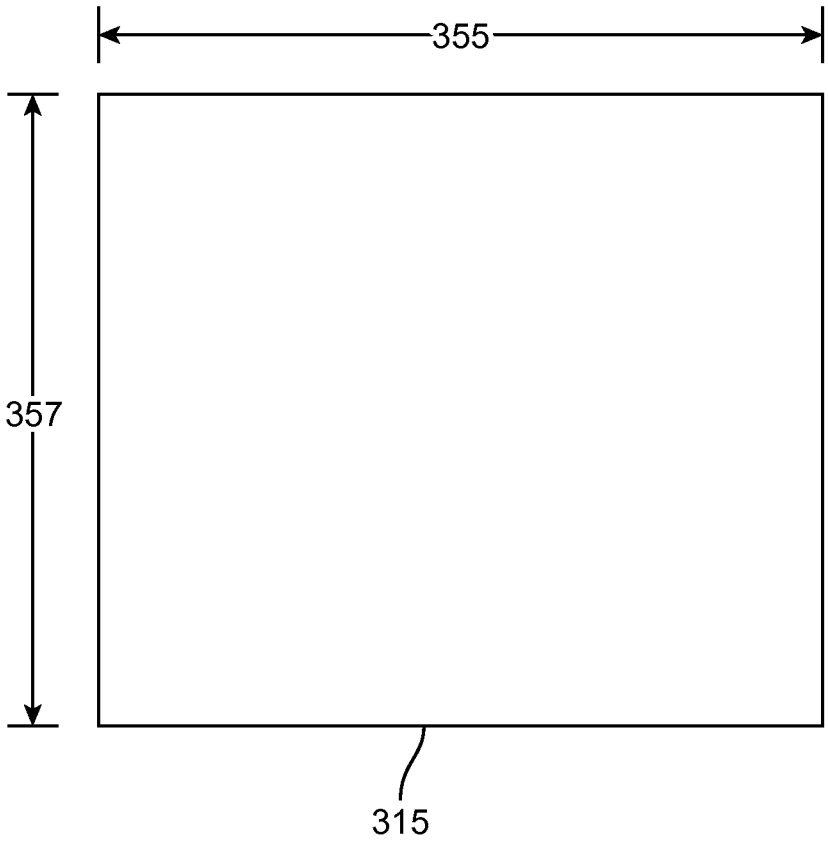
FIG. 12 is an end, plan view of a hose handling system according to an embodiment of the present invention.

As best shown in FIG. 12, the first frame member 315 typically has a width 355 of 2 inches plus or minus 1/16 inch, and a depth 357 of 1.75 inches plus or minus 1/16 inch. The second frame member (not shown in FIG. 12) typically has width and depth dimensions identical to the first frame member. The dimensions of the third embodiment are merely exemplary; other embodiments include frame members with width and depth dimensions that differ from those of the third embodiment illustrated in FIG. 12.

The third embodiment hose guide is typically, but not necessarily, made entirely in the United States of America. Some embodiments of aluminum frame members are hard anodized, and colors may be imparted to the frame members.

A Method of Making Frame Members

Figure 13:
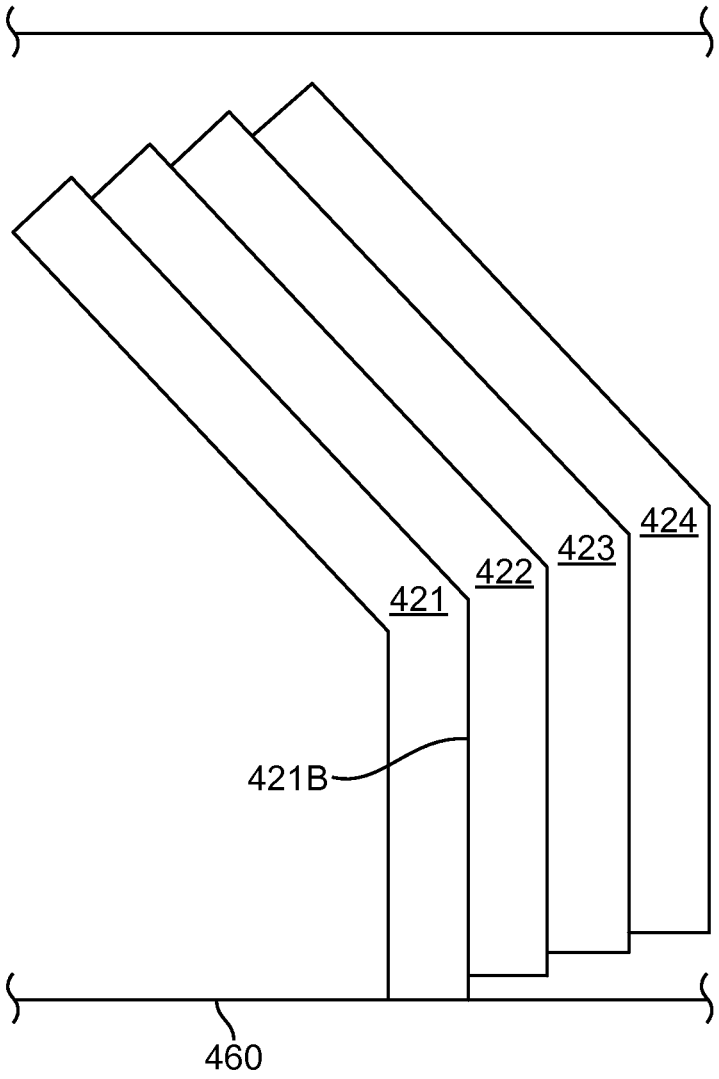
FIG. 13 is a top, plan view of a hose handling system according to an embodiment of the present invention.

A method of making multiple frame members of a hose guide is illustrated in FIG. 13. Multiple nascent frame members 421, 422, 423, 424 are typically cut from a single 6061 aluminum billet 460. FIG. 13 illustrates how cut 421B creates an edge for both nascent frame member 421 and nascent frame member 422. The aluminum billet is typically 1.75 inch thick, so each of the nascent frame members is also 1.75 inch thick. Each of the multiple nascent frame members can be machined to form either of a first or a second frame member. The nascent frame members are typically identical to each other prior to machining

Alternative Embodiments and Variations

Various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art given the benefit of this disclosure. All variations of the invention that read upon appended claims are intended and contemplated to be within the scope of the invention.

In an alternate embodiment, a hose guide includes no nozzles or valve, and is thus not adapted to dispense a wash mixture or other fluid onto a hose. Variations include hose guide assemblies without channels in the frame members.

Figure 14:
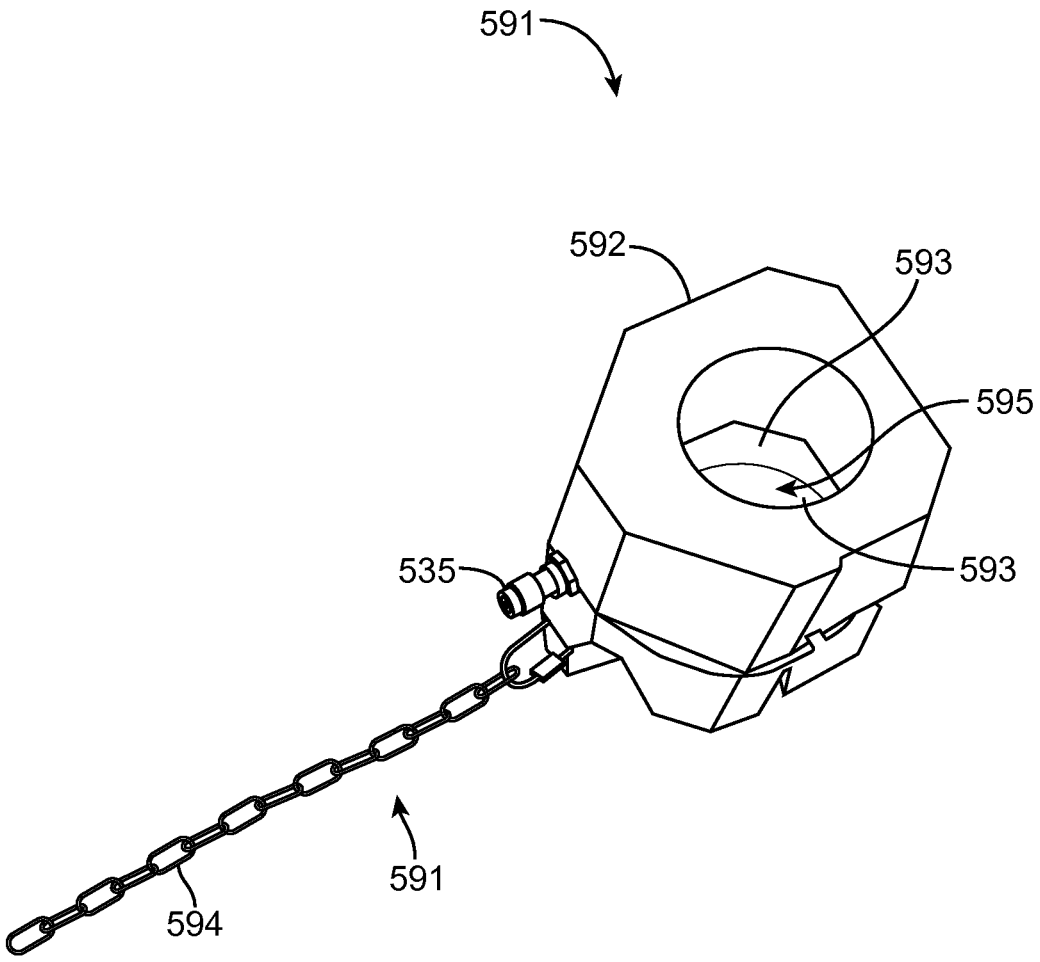
FIG. 14 is a perspective view of a hose handling system according to an embodiment of the present invention.
Figure 15:
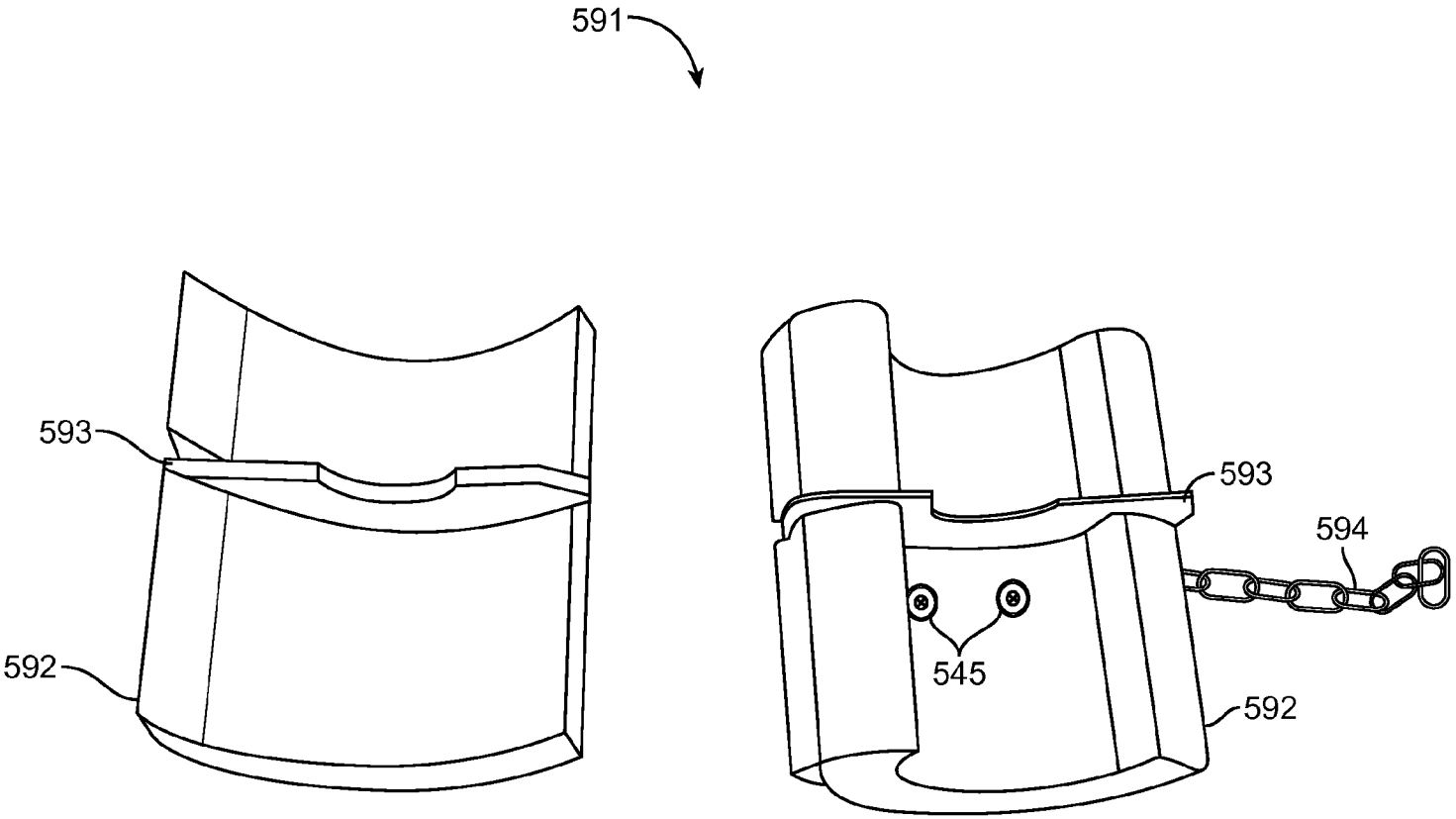
FIG. 15 is a perspective view of a hose handling system according to an embodiment of the present invention.
Figure 16:
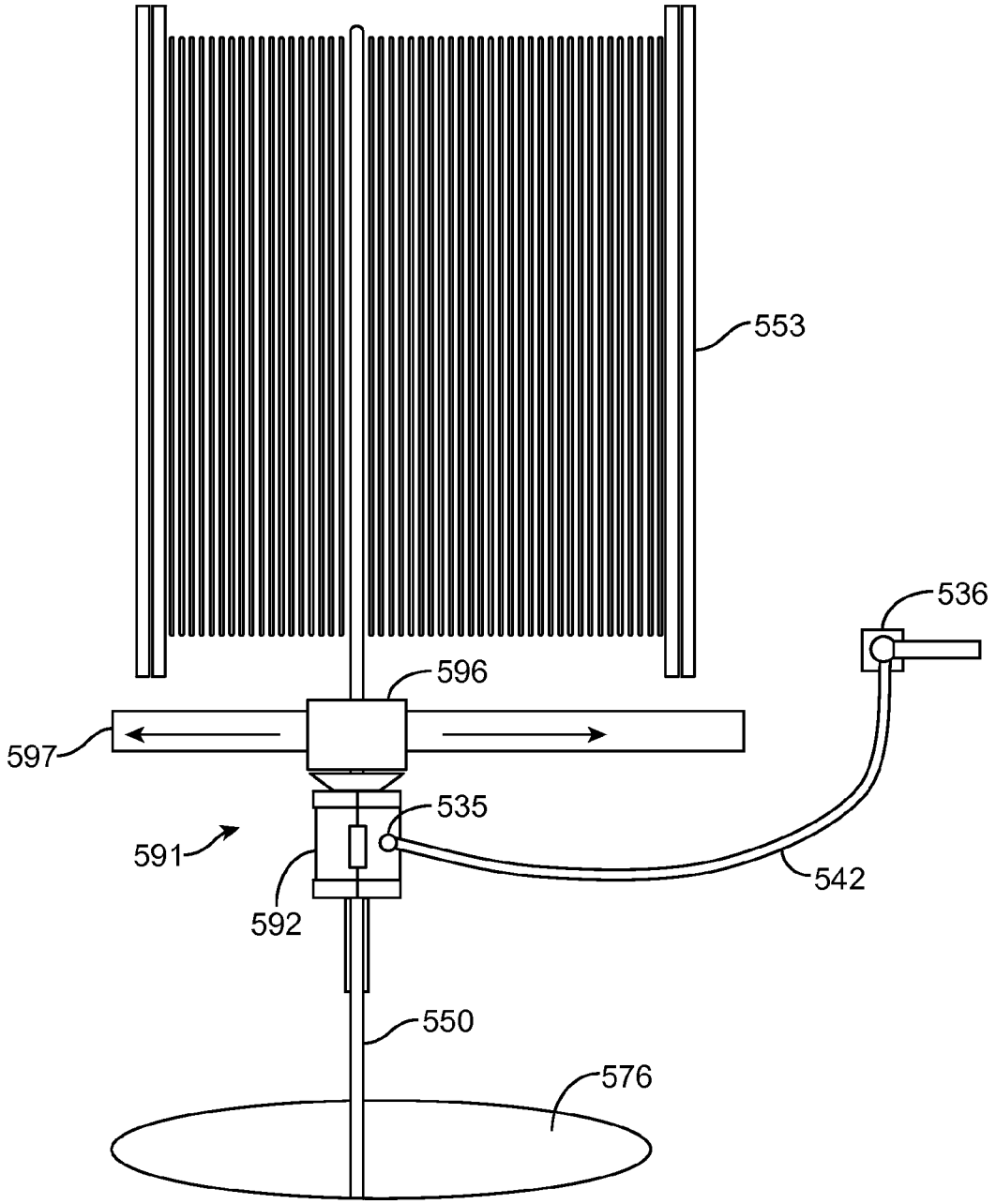
FIG. 16 is a plan view of a hose handling system according to an embodiment of the present invention.

Another alternative embodiment of a hose handling system is illustrated in FIGS. 14-16. The alternative embodiment includes a hose washing assembly 591 comprising a housing 592 within which resides a flange 593 surrounding a flange aperture 595, a fluid inlet fitting 535, and spray jets 545. The fluid inlet fitting is in fluid communication with the spray jets, and wash mixture or other fluid can be delivered to the spray jets through the fluid inlet fitting. The flange aperture typically, but not necessarily, has a diameter of about 1.5 inches. Variations of the hose washing assembly further comprise a tether 594. The housing 592 typically comprises expanded polyethylene foam, and the flange 593 comprises synthetic rubber including polymers such as, but not limited to, 1,3 butadiene and substituted butadienes, chloroprene, methylpropene, and isoprene. Some flange embodiments comprise natural rubber, vulcanized rubber, natural polymers, synthetic polymers, or other resilient, pliant material adapted to conform about a hose received through the flange aperture 595.

The hose washing assembly 591 is adapted to split into two sections, as best seen in FIG. 15, in order to receive a hose. In typical use, the hose washing assembly is reassembled into a single unit surrounding a hose after the hose has been received therein. The hose can then be reeled in or otherwise drawn through the hose washing assembly while wash mixture or other fluid is sprayed through the nozzles 545 onto the hose. The flange 593 can facilitate removal of contamination on the hose by scraping or otherwise rubbing against the hose as it moves through the flange aperture 595. The tether 594 is typically fastened to a secure sewer truck part in order to restrain the hose washing assembly as a hose is drawn through the wash assembly. The hose washing assembly illustrated in FIGS. 14-16 can be used with or without a hose guide.

As shown in FIG. 16, the hose washing assembly 591 can be used to wash a high pressure hose 550 as the hose is withdrawn from a manhole 576 onto a hose reel 553. The hose reel typically resides on a sewer cleaning vehicle. The hose washing assembly 591 is coupled to a reel positioner 596 that orients the high pressure hose 550 properly as the hose 550 is wound onto the hose reel 553. The reel positioner 596 typically travels laterally, back and forth across a positioner bar 597 as the hose 550 is wound onto the reel 553. Embodiments of the hose washing assembly 591 further comprise a wash line 542 configured to conduct a liquid from a fluid delivery device to the fluid inlet fitting 535, and an inlet valve 536 configured to modulate delivery of the liquid through the wash line. The liquid is typically a wash mixture comprising an antimicrobial agent or a surfactant.

I claim:

1. A method of using a hose handling system comprising:
providing a hose handling system, the hose handling system including:
a hose guide comprising:
a rigid frame;
a pulley coupled to the frame;
a nozzle coupled to the frame next to the pulley and configured to direct wash spray proximate the pulley;
a fluid delivery device including:
a wash line in fluid communication with the hose guide, the wash line being configured to deliver liquid to the hose guide at a pressure of at least 50 pounds per square inch;
a wash concentrate tank;
a water tank in fluid communication with a fluid path;
a metering pump in fluid communication with the wash concentrate tank and configured to deliver wash concentrate tank contents to the fluid path; and
a main pump configured to deliver liquid to the wash line at a delivery pressure of at least 50 pounds per square inch (psi);
placing the hose guide over a manhole;
withdrawing a hose from within a sewer through the manhole;
traversing the pulley with the hose; and
delivering a wash mixture to the hose guide through the wash line.

2. The method of claim 1, wherein:
the wash tank resides on a sewer cleaning vehicle;
the wash concentrate tank contains a wash concentrate including an antimicrobial agent or a surfactant; and
the wash line is detachably coupled directly to the hose guide.

3. The method of claim 1, wherein the wash concentrate tank contains a wash concentrate including a quaternary ammonium compound and a surfactant.

4. The method of claim 3, wherein the wash tank concentrate further comprises an alcohol or a glycol.

5. A method of using a hose handling system, comprising:
providing a hose handling system, the hose handling system including:
a hose guide comprising:
a rigid frame;
a pulley coupled to the frame;
a nozzle coupled to the frame next to the pulley and configured to direct wash spray proximate to the pulley;
a fluid delivery device including:
a wash line in fluid communication with the hose guide, the wash line being configured to deliver liquid to the hose guide at a pressure of at least 50 pounds per square inch;
a wash concentrate tank;
a water tank residing on a sewer cleaning vehicle, the water tank being in fluid communication with a fluid path;
a metering pump in fluid communication with the wash concentrate tank and configured to deliver wash concentrate tank contents to the fluid path; and
a main pump configured to deliver liquid to the wash line at a delivery pressure of at least 50 pounds per square inch (psi)
placing the hose guide over a manhole with the pulley residing directly above the manhole;
withdrawing a hose from within a sewer through the manhole;
traversing the pulley with the hose;
delivering a wash mixture to the hose guide through the wash line;
spraying the wash mixture through the nozzle onto the hose.

6. The method of claim 5, further comprising passing a sewer vacuum line through the manhole while the hose guide remains in place over the manhole.

7. The method of claim 6, further comprising:
delivering a wash concentrate from the wash concentrate tank to the fluid path, the wash concentrate including an antimicrobial agent and a surfactant;
making the wash mixture by diluting the wash concentrate with water from the water tank.

8. The method of claim 7, wherein:
the hose guide further comprises a channel residing within the rigid frame, the channel being in fluid communication with the wash line and the nozzle;
the rigid frame is generally Y-shaped and comprises a base and two arm portions coupled to the base, the two arm portions being non-parallel and converging as they approach the base;
the pulley is coupled directly to the base; and
the sewer vacuum line passes between the two arm portions.

9. A method of using a hose handling system comprising:
providing a hose handling system, the hose handling system including:
a hose guide comprising:
a rigid frame;
a pulley coupled to the frame;
a nozzle coupled to the frame next to the pulley and configured to direct wash spray proximate the pulley;
a fluid delivery device including a wash line in fluid communication with the hose guide, the wash line being configured to deliver liquid to the hose guide at a pressure of at least 50 pounds per square inch;
placing the hose guide over a manhole;
withdrawing a hose from within a sewer through the manhole;

traversing the pulley with the hose, wherein the pulley resides directly above the manhole;

delivering a wash mixture to the hose guide through the wash line;

spraying the wash mixture through the nozzle onto the hose; and passing a sewer vacuum line through the manhole while the hose guide remains in place over the manhole.

10. A hose handling system for use in retrieving hose from a sewer, the hose handling system comprising:

a hose guide including:

a rigid frame;

a pulley coupled to the rigid frame;

an inlet valve including an open position configured to allow liquid flow therethrough, and a closed position configured to block liquid flow;

a nozzle coupled to the rigid frame next to the pulley and in fluid communication with the inlet valve, the nozzle being configured to direct a spray of liquid proximate the pulley; and a channel system including a channel residing within the rigid frame, the channel being in fluid communication with the nozzle and the inlet valve.

11. The hose handling system of claim 10, wherein the rigid frame comprises a first frame member and a second frame member, each of the first and second frame members including a base portion coupled to an arm portion, wherein:

the channel resides within the base portions;

the pulley comprises (i) a roller residing between the base portions and (ii) an axle coupled to each of the base portions; and the rigid frame is Y-shaped with the arm portions converging as they approach the base portions.

12. The hose handling system of claim 11, wherein:

the frame members are mirror images of each other;

the nozzles include a nozzle installed in the first frame member and a nozzle installed in the second frame member; and the base portions are parallel.

13. A hose handling system for use in retrieving hose from a sewer, the hose handling system comprising:

a hose guide including:

a rigid frame, the rigid frame being generally Y-shaped and comprising:

a base; and two arm portions coupled to the base, the two arm portions being non-parallel and converging as they approach the base;

a pulley coupled to the frame;

an inlet valve including an open position configured to allow liquid flow therethrough, and a closed position configured to block liquid flow; and a nozzle coupled to the frame next to the pulley and in fluid communication with the inlet valve, the nozzle being configured to direct a spray of liquid proximate the pulley;

a fluid delivery device including a wash line in fluid communication with the hose guide, the wash line being configured to deliver liquid to the hose guide at a pressure of at least 50 pounds per square inch;

a wash concentrate tank;

a water tank in fluid communication with a fluid path;

a metering pump in fluid communication with the wash concentrate tank and configured to deliver wash concentrate tank contents to the fluid path; and a main pump configured to deliver liquid to the wash line at a delivery pressure of at least 50 pounds per square inch (psi).

14. A hose handling system comprising:

a hose guide including:

a rigid frame;

a pulley coupled to the frame;

a nozzle coupled to the frame next to the pulley and configured to direct wash spray proximate the pulley;

a fluid delivery device including:

a wash line in fluid communication with the hose guide, the wash line being configured to deliver liquid to the hose guide at a pressure of at least 50 pounds per square inch;

a wash concentrate tank;

a water tank residing on a sewer cleaning vehicle, the water tank being in fluid communication with a fluid path;

a metering pump in fluid communication with the wash concentrate tank and configured to deliver wash concentrate tank contents to the fluid path; and a main pump configured to deliver liquid to the wash line at a delivery pressure of at least 50 pounds per square inch (psi).

* * * * *